United States Patent [19]

Yamasaki

[11] Patent Number: 4,638,848

[45] Date of Patent: Jan. 27, 1987

[54] METAL MOULD AND VENTHOLE ARRANGEMENT THEREOF

[76] Inventor: Kojiro Yamasaki, 10-10, Ikedauemachi, Nagata-Ku, Kobe-Shi, Hyogo 653, Japan

[21] Appl. No.: 456,083

[22] PCT Filed: Jul. 15, 1981

[86] PCT No.: PCT/JP81/00163

§ 371 Date: Dec. 16, 1982

§ 102(e) Date: Dec. 16, 1982

[87] PCT Pub. No.: WO83/00301

PCT Pub. Date: Feb. 3, 1983

[51] Int. Cl.[4] ..... B22D 17/00

[52] U.S. Cl. ..... 164/305; 164/410

[58] Field of Search ..... 164/305, 410, 234

[56] References Cited

U.S. PATENT DOCUMENTS 4,154,285 5/1979 Yamasaki ..... 164/305 X

FOREIGN PATENT DOCUMENTS 54-143728 11/1979 Japan ..... 164/305

196204 5/1965 Sweden .

*Primary Examiner*—Kuang Y. Lin

*Attorney, Agent, or Firm*—Wenderoth, Lind & Ponack

[57] ABSTRACT

This invention relates to a metal mould for use in die casting. Such a metal mould is required to have a venthole arrangement through which a gas within a cavity is discharged out of the metal mould as molten metal is poured into the cavity. The invention is characterized by a venthole arrangement which comprises inclined grooves (5, 6) being formed in the facing surfaces of two half portions (1, 2) of the metal mould having the cavity defined therebetween, communicating with the cavity and a safe cavity (7), and inclining in a direction opposite to each other. With the arrangement of the invention, a gas can be effectively discharged out of the metal mould without spouting out molten metal.

3 Claims, 4 Drawing Figures

METAL MOULD AND VENTHOLE ARRANGEMENT THEREOF

FIELD OF THE INVENTION

This invention relates to a metal mould for use mainly in die casting and more particularly to a venthole arrangement in the metal mould adapted to discharge the air within the metal mould without spouting molten metal.

DESCRIPTION OF THE PRIOR ART

It has been known that a metal mould is provided with a venthole in communication with the cavity so that the air within the metal mould can be discharged out of the mould when a charge of molten metal is poured into the mould for carrying out a casting operation. However the conventional gas discharge out of metal moulds has been performed by providing a clearance having a thickness or cross-section area on the order of 0.15 mm between the opposing or inner surfaces of the mating half portions of the metal mould. The reason for which the gas discharge clearance thickness or cross-section aarea is limited to 0.15 mm is that when molten metal comes to contact the cold inner or opposing surfaces of the two half portions of the metal mould, the molten metal instantly assumes a partially solidified state and increases its viscosity. The partially solidified molten metal with increased viscosity instantly becomes a laminar flow, the mould surface contacting portion of which tends to solidify to thereby form a thin solidified metal film. Since the inner portion of the molten metal advances upwardly at a higher speed than the mould surface contacting portion, the pressure within the metal mould drops and the contact between the mould surfaces and solidified metal film becomes an undesirable condition resulting in insufficient heat transfer between the molten metal and mould surfaces whereby the inner portion of the molten metal spouts out of the metal mould while maintaining its high temperature.

SUMMARY OF INVENTION

A metal mould of the invention comprises a plurality of first inclined gas escape grooves formed in an inner surface of a removable half portion of the metal mould, and a plurality of second inclined gas escape grooves formed in an inner surface of a fixed half portion of the metal mould in opposing relationship to the first inclined gas escape grooves and extending in a direction opposite to that of the first inclined gas escape grooves, the first and second inclined gas escape grooves communicating with a cavity in the metal mould. With the arrangement of the invention, since the first and second inclined gas escape grooves cross each other at many points, the molten metal flowing through the gas escape grooves impinges at the cross points is prevented from flowing out of the metal mould while the gas within the cavity is positively discharged out of the metal mould because of the large cross-sectional area of the inclined grooves.

DETAILED DESCRIPTION OF THE INVENTION

Figure 1:
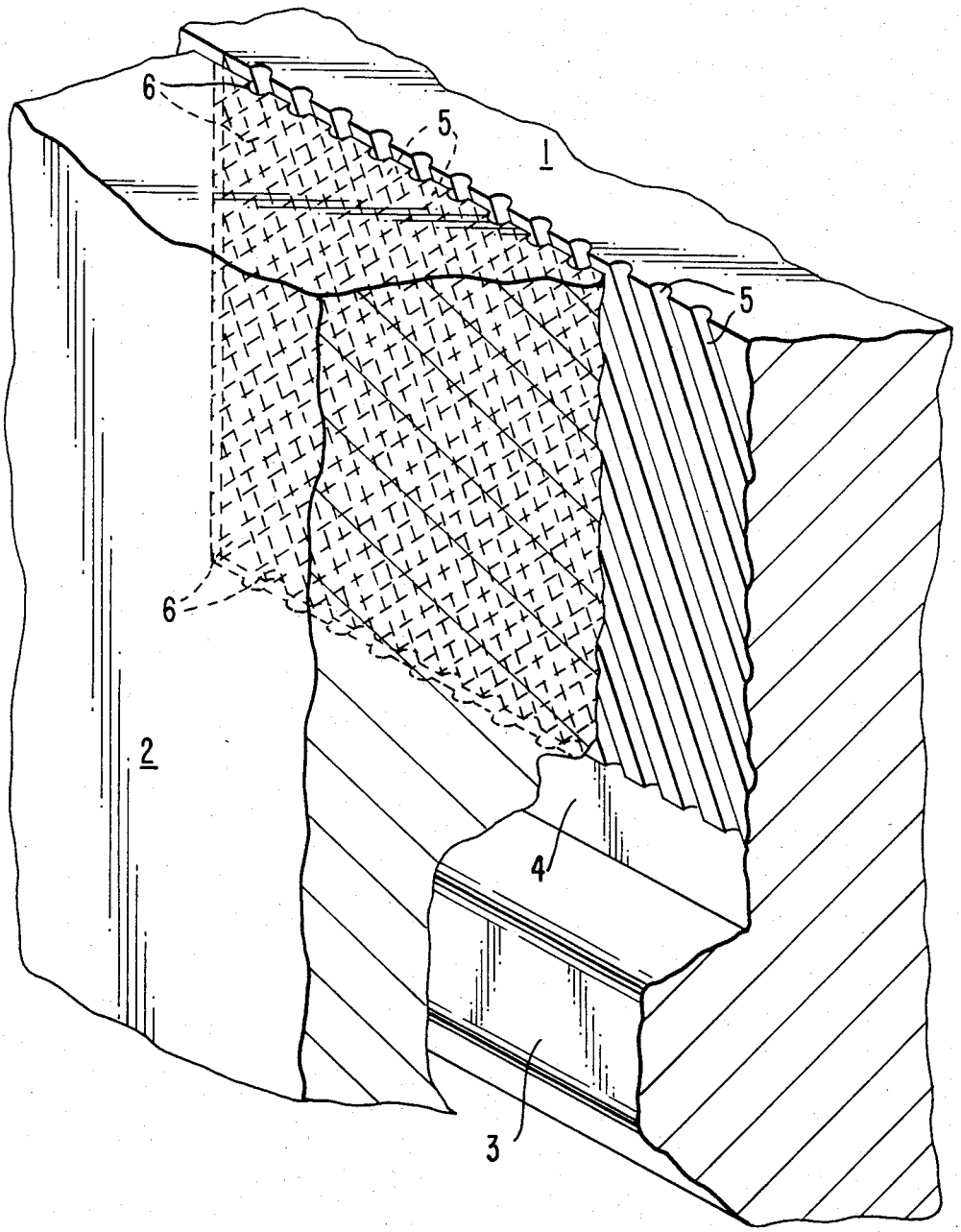
FIG. 1 is a perspective view of one preferred embodiment of a metal mould constructed in accordance with the present invention with a portion thereof broken away.
Figure 3:
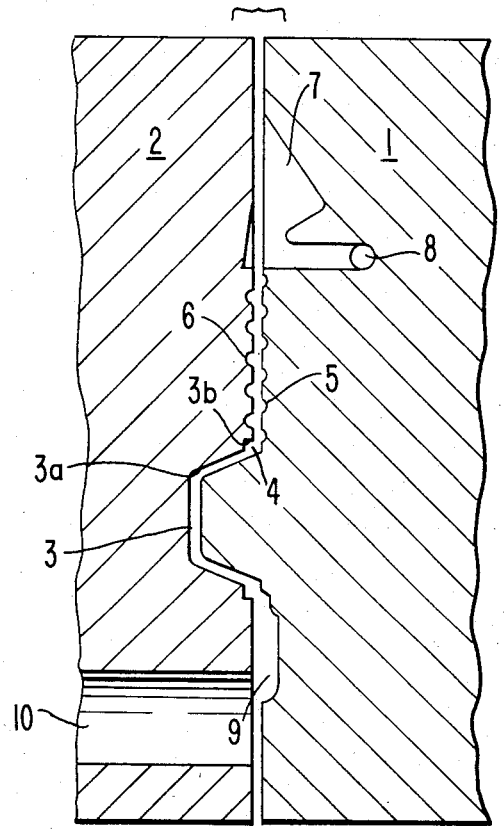
FIG. 3 is a vertically sectional view of the metal mould as shown in FIG. 1.
Figure 4:
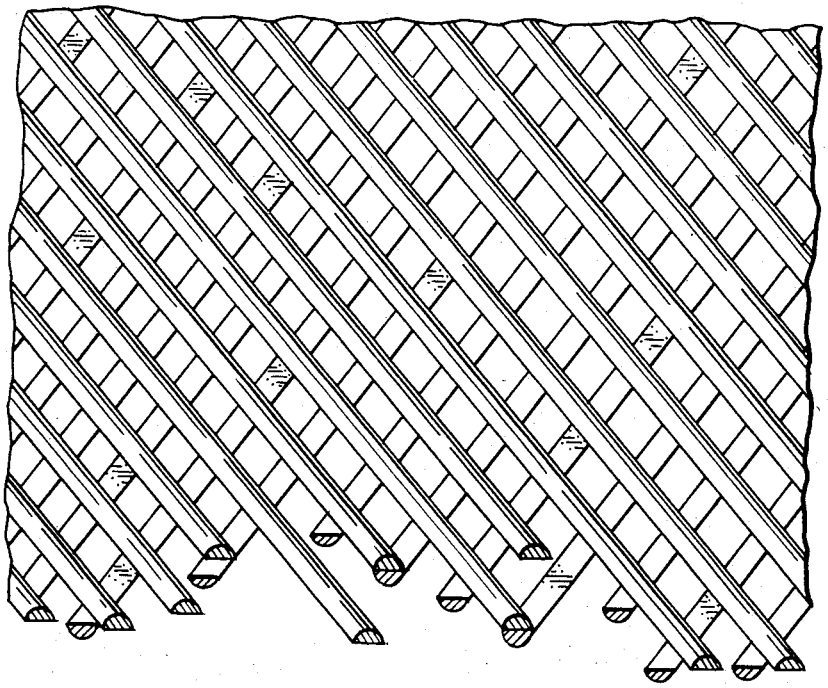
FIG. 4 is a fragmentary perspective view showing the flow pattern of molten metal in an inclined gas escape groove arrangement in the metal mould of the invention.

The present invention will be described referring to the accompanying drawings in which one preferred embodiment of the metal mould of the invention is shown for purpose of illustration, As shown in FIG. 1, the metal mould generally comprises a removable half portion 1 and a mating fixed half portion 2 which portions 1 and 2 are adapted to be assembled together in spaced face-to-face relationship. The two half portions 1 and 2 are held in their assembled condition by conventional fastening means (not shown). The removable half portion 1 is integrally formed on the inner surface with a trapezoidal-shaped cross-sectional projection 3 extending inwardly from the inner surface. As shown in FIG. 3, the fixed half portion 2 is formed on the inner surface opposing that of the removable half portion 1 with a trapezoidal-shaped cross-sectional recess **3*a* which is adapted to receive the projection 3 when the two half portions 1 and 2 are assembled together. The recess 3*a* has a larger dimension than that of the projection 3 so that when the two half portions 1 and 2 are assembled together, the projection 3 and recess 3*a* define the cavity therebetween. The inner surface of the fixed half portion 2 is further formed with a second recess 3*b* just above and contiguous to the first recess 3*a* to provide a venthole area 4 in communication with the moulding cavity when the moulding cavity is formed. The inner surface of the removable half portion 1 is further formed with a plurality of upwardly extending parallel and spaced inclined gas escape grooves 5 with the inlet or lower ends of the grooves 5 adapted to be positioned just above and to communication with the venthole area 4 when the two half portions 1 and 2 are assembled together. The outlet or upper ends of the grooves 5 are in communication with a vacuum source through means which will be described hereinafter. The inclined gas escape grooves 5 may incline with respect to the vertical at an angle within the range of about 5°–85° and have a semi-circular cross-section. Similarly, a plurality of upwardly extending spaced and parallel inclined gas escape grooves 6 are formed in the inner surface of the fixed half portion 2 and adapted to oppose the respectively corresponding inclined gas escape grooves 5 in the removable half portion 1 when the two half portions 1 and 2 are assembled together. The inclined gas escape grooves 6 may also incline with respect to the vertical axis at an angle within the range of 5°–85°, but the inclining direction of the grooves 6 is opposite from that of the grooves 5. The grooves 6** also have a semi-circular cross-section.

Figure 2:
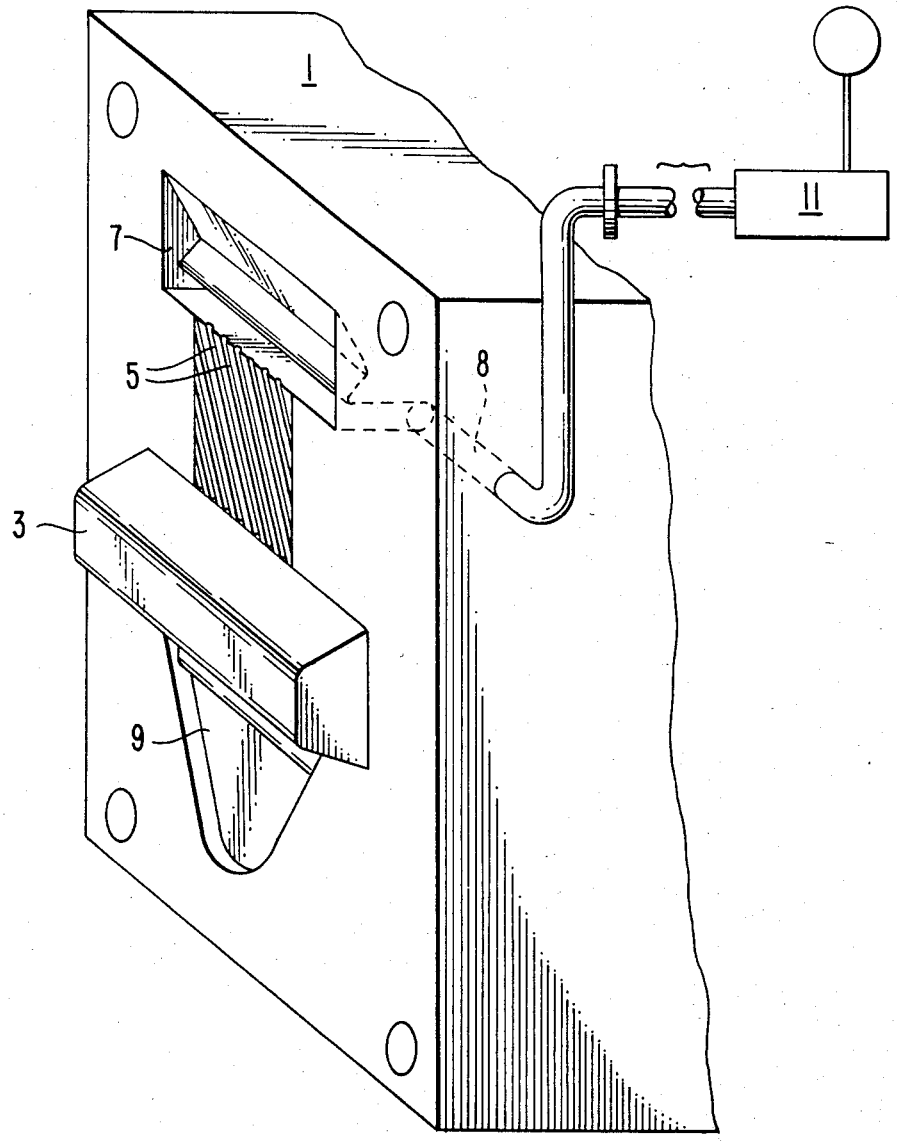
FIG. 2 is a fragmentary perspective view of a removable half portion of the metal mould as shown in FIG. 1.

A horizontal safety cavity is provided in the removable half portion 1 adjacent to the bottom and has the bottom in communication with the upper or outlet ends of the inclined gas escape grooves 5. There is also provided in the removable half portion 1 a communication hole 8 which is in communication at one end with one end of a safety cavity 7 and at the other end with a vacuum pump 11 (FIG. 2 only). Also provided in the removable half portion 1 adjacent to and in communication with the lower or inlet end of the moulding cavity is a sprue runner 9 which is in turn in communication with a pouring gate 10 formed in the fixed half portion 2.

With the above-mentioned construction and arrangement of the components of the metal mould of the present invention, in operation, a charge of molten metal is poured under pressure into the metal mould at the pouring gate 10 by a cylinder (not shown) and the molten metal then flows through the sprue runner 9 into the cavity from where the molten metal rises upwardly into the opposing inclined gas escape grooves 5 and 6. However, as the molten metal advances upwardly along the opposing inclined gas escape grooves 5 and 6 in discrete flows towards the upper or outlet ends of the grooves 5 and 6 which extend in the opposite directions, the adjacent or inner portions of the discrete molten metal flowing within the opposing inclined grooves 5 and 6 repeatedly impinge against each other at an angle and advance aslant with respect to the vertical while intersecting each other at an angle. Thus, the molten metal is stirred up and prevented from forming a laminer flow. Furthermore, the impinging of the adjacent or inner portions of the discrete molten metal flows advancing along the opposing inclined gas escape grooves 5 and 6 functions to retard the advance movement of the discrete molten metal flows so as to eliminate any appreciable difference in cooling between the metal mould contacting portion and the inner portion of the molten metal which cooling difference may otherwise occur when the molten metal flows in a laminar flow. The impinging also eliminates any accident in which any partially solidified outer portion of the molten metal bursts to allow an underlying portion of the molten metal which is in a molten state to spout out of the interior of the burst solidified metal portion. Furthermore, according to the present invention, it is assured that the molten metal solidifies positively and uniformly throughout the wide cross-sectional area of the inclined gas escape grooves 5 and 6 and the moulding cavity can be perfectly cleared of gas with the simple construction of the gas escape groove arrangement of the present invention.

I claim:

1. A metal mould comprising:

a removable half portion having an inner surface and a trapezoidal-shaped cross-sectional projection, said projection being integrally formed with and projecting inwardly from the inner surface of the removable half portion;

a vacuum pump in communication with the removable half portion;

a mating fixed half portion having an inner surface with a first recess means therein, said first recess means having dimensions larger than that of the projection on the removable half portion and being adapted to receive the projection in order to define a first cavity therewith when the inner surfaces of the removable and fixed half portions are mated together;

a venthole arrangement having a plurality of upwardly extending parallel and spaced first inclined gas escape grooves having lower inlet ends and upper outlet ends, said first grooves being formed in the inner surface of the removable half portion in communication at said lower inlet ends with the first cavity;

a horizontally oriented second safety cavity having a bottom and being formed in the removable half portion in communication at said bottom with the upper outlet ends of the first grooves;

a hole means, having two ends and being formed in the removable half portion, for communicating at one end with the safety cavity and at the other end with the vacuum pump; and a plurality of upwardly extending parallel and spaced second inclined gas escape grooves having two ends and being formed in the inner surface of the fixed half portion in opposing relationship to the first grooves in communication at one end with the lower inlet ends of the first grooves leading to the first cavity and in communication at the other end with the upper outlet ends of the first grooves leading to the safety cavity;

said first and second grooves being inclined at an angle within a range of about 5° to about 85° with respect to a vertical axis and extending in opposite directions to each other so that a criss-cross pattern with cross points is formed;

whereby molten metal flowing through the first and second grooves impinges at the cross points and is prevented from forming a laminar flow, which causes appreciable differences in cooling, while gas between the mated removable and fixed half portions is positively discharged therefrom.

2. The metal mould according to claim 1, further comprising:

a second recess means, formed in the inner surface of the mating fixed half portion, for communicating the first cavity with the lower inlet ends of the first grooves and the one ends of the second grooves.

3. The metal mould according to claim 1, wherein:

said first and second grooves have semi-circular cross-sections.

* * * * *